United States Patent [19]

Prasad

[11] Patent Number: 4,627,458

[45] Date of Patent: Dec. 9, 1986

[54] ONE-STEP PROCESS FOR TRANSFORMING A WATER-IN-OIL EMULSION INTO AN OIL-IN-WATER EMULSION

[75] Inventor: Rama R. S. Prasad, Bakersfield, Calif.

[73] Assignee: Occidental Petroleum Corporation, Los Angeles, Calif.

[21] Appl. No.: 802,851

[22] Filed: Nov. 27, 1985

Related U.S. Application Data

[63] Continuation-in-part of Ser. No. 585,435, Mar. 2, 1984, abandoned.

[51] Int. Cl.[4] ..... F17D 1/16

[52] U.S. Cl. ..... 137/13

[58] Field of Search ..... 137/13; 252/8.55

*Primary Examiner*—Alan Cohan

*Attorney, Agent, or Firm*—Christie, Parker & Hale

[57] ABSTRACT

There is provided a process for the formulation of an oil-in-water emulsion from a produced hydrocarbon crude which includes a water-in-oil emulsion. A surface-active chemical system is added with agitation to the crude when such crude is at a temperature of from about 100° to about 200° F., in a quantity sufficient to formulate and then sustain an oil-in-water emulsion at pipeline conditions of temperature and shear. Water-content is from about 15 percent to about 35 percent by weight. Viscosity is sufficiently low for pipeline transportation. Any excess water is separated from the formed oil-in-water emulsion prior to pipelining. The oil-in-water emulsion is one that can easily be dewatered and desalted to the necessary marketing specifications at the downsteam end of the pipeline, using known technology.

17 Claims, 2 Drawing Figures

ONE-STEP PROCESS FOR TRANSFORMING A WATER-IN-OIL EMULSION INTO AN OIL-IN-WATER EMULSION

CROSS-REFERENCE TO RELATED APPLICATIONS

This application is a continuation-in-part of application Ser. No. 585,435, filed Mar. 2, 1984, now abandoned.

BACKGROUND OF THE INVENTION

Produced crude oil in the field can have substantial quantities of water associated with it. The water-cut or amount of water associated with the oil can be as high as 95% of the total produced stream. This is especially true in heavy oil fields where the oil is being produced from reservoir(s) having a strong water drive. Usually, the heavy oil itself is so viscous at ambient temperatures that it requires tremendous pumping energy to make it flow, if at all. The water present in the produced stream can be classified into two categories: "bound" water and "free" water. "Bound" water is that water which is locked up in the oil as a water-in-oil (W/O) emulsion. Separating this water from the stream typically requires applying the appropriate combination of heat, mixing and a chemical demulsifier. "Free" water is that water which is relatively loosely held up by the oil and can be removed just by heating the stream to the right temperature.

The above-mentioned produced water-in-oil (W/O) emulsions usually have a higher viscosity than the dry oil which itself is very viscous. This high viscosity frequently limits the rate at which the W/O emulsion, and hence the oil contained in it, can be pumped up a wellbore or through a pipeline. One method for handling this problem has been to formulate an oil-in-water (O/W) emulsion of the oil. Oil-in-water emulsions usually have a lower viscosity than the oil itself and so the oil in this form can be pumped at faster rates. Crude oil-in-water emulsions have been formulated in one of two ways:

One approach has been to take the produced stream from the wellbore and separate out the water by subjecting it to a combination of heat, mixing and at least one chemical demulsifier in a heater-treater. The "dry" oil stream which may contain anywhere from 1–5% water by weight is then mixed with the right amount of water and a chemical emulsifying agent to form a low viscosity, transportable oil-in-water emulsion. The amount of water used is governed by the need to obtain a low viscosity transport fluid and to maximize the oil throughput. Normally, a transport O/W emulsion contains from about 15% to about 35% water by weight.

The other approach has been to attempt to form an oil-in-water emulsion within the wellbore itself. Water containing one or more emulsifying agent(s) is usually added either down the annulus or the tubing to contact the oil and water coming from the formation into the wellbore before or as they enter the downhole pump. In this way, an O/W emulsion of the crude is formed as the fluids pass through the downhole pump. This downhole attempt at forming O/W emulsions presents considerable operational difficulties. Each well behaves independently of any other well. There are presented, therefore, a number of operational variables from well to well which must be constantly combatted if a suitable O/W emulsion is to be formed. More serious is that, in order to produce the oil to the surface, it is necessary to use some artificial lifting device, and where water content is high, energy requirements for the lifting devices are also high. This will affect the chemical dosage used. For example, in the case of heavy oil wells with high water cuts wherein enormous amounts of total fluid (oil plus water) have to be lifted to get reasonable oil production rates, it is becoming common to use electrical submersible pumps (ESP) which can pump out these fluids at tremendous rates. The formation of an O/W emulsion is determined by the temperature, chemical emulsifier dosage and degree of shear or mixing. In a well using an ESP which generates a lot of shear, an excessive amount of chemical may be required to successfully formulate, if at all, an O/W emulsion.

SUMMARY OF THE INVENTION

According to this invention, there is provided a method for formulating a pipeline-transportable crude oil-in-water (O/W) emulsion by taking the output of one or more crude oilfield well(s) and directly inverting the produced stream of a water-in-oil (W/O) emulsion and "free" water, if any. The formulated O/W emulsion contains from about 15% to 35% by weight of water and has the necessary low viscosity and stability to withstand long pipelining periods and any pipeline shutdowns and start-ups. The O/W emulsion can easily be dewatered and desalted to the necessary marketing specifications at the downstream end of the pipeline, using known technnology. The method involves using one or more surface-active agent(s) and agitation at temperatures ranging from about 100° F. to about 200° F. to invert the produced W/O emulsion and "free" water in one process step to form the O/W emulsion. The purpose is to coalesce all the water agent(s) and agitation at temperatures ranging from about 100° F. to about 200° F. to invert the produced W/O emulsion and "free" water in one process step to form the O/W emulsion. The purpose is to coalesce all the water contained in the produced stream of the W/O emulsion and the "free" water into one continuous phase and simultaneously disperse the oil in the form of small droplets in this continuous water phase.

There may be employed a single surface-active agent (emulsifier) if it is capable of forming and then sustaining the emulsion over a broad temperature range. A mixture of surface-active agents may be desirably (emulsifier) employed. Depending on emulsifier, concentration may range from about 100 to about 5,000 ppm by weight, of the crude. Where the as-produced W/O emulsion is of high water-content, e.g., about 50% or more water, the amount of emulsifier employed is just sufficient to stabilize an O/W emulsion at a 15% to 35% water-content. That water which is unnecessary to sustain the O/W emulsion is allowed to separate from the O/W emulsion prior to introduction of the O/W emulsion, at the desired water content, into a pipeline. Conversely, when the crude contains less water than is required to form a low-viscosity transportable O/W emulsion, water can be added to the W/O emulsion prior to or during transformation into the O/W emulsion suitable for pipeline transportation.

DETAILED DESCRIPTION

The invention is directed towards formulating pipeline-transportable oil-in-water (O/W) emulsions by directly inverting a produced stream of a water-in-oil (W/O) emulsion with or without "free" water, with the aid of an emulsifier (surface-active chemical), normally a mixture of emulsifiers. Furthermore, the invention is also directed towards controlling the characteristics of the O/W emulsion such that it is suitable for pipelining over long distances, e.g., the viscosity, water-content and stability of the emulsion. The formulated O/W emulsion should be easily dewatered and desalted to the necessary marketing specifications at the downstream end of the pipeline, using known technology.

Figure 1:
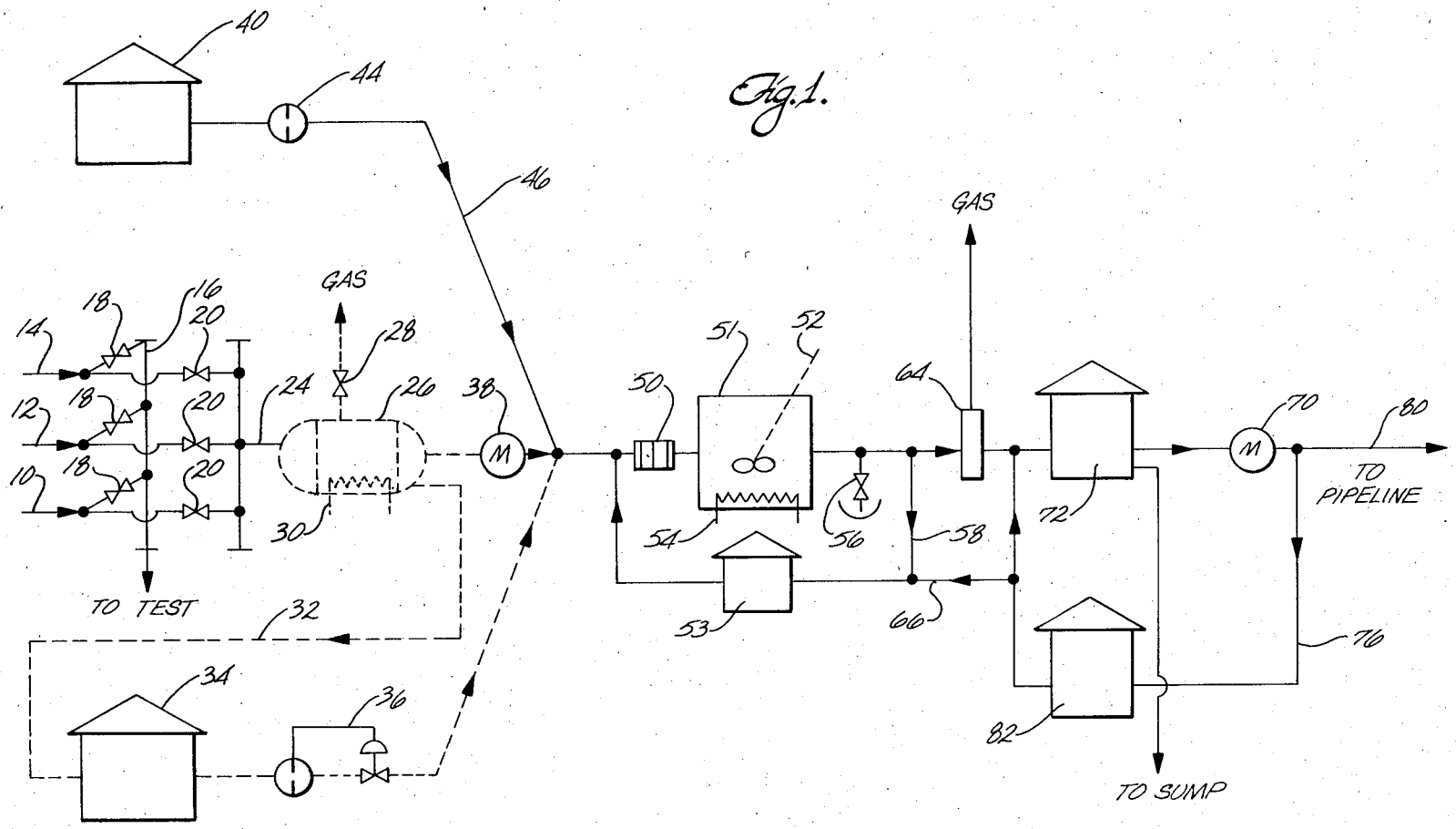
FIG. 1 illustrates the presently preferred system for practice of the invention.
Figure 2:
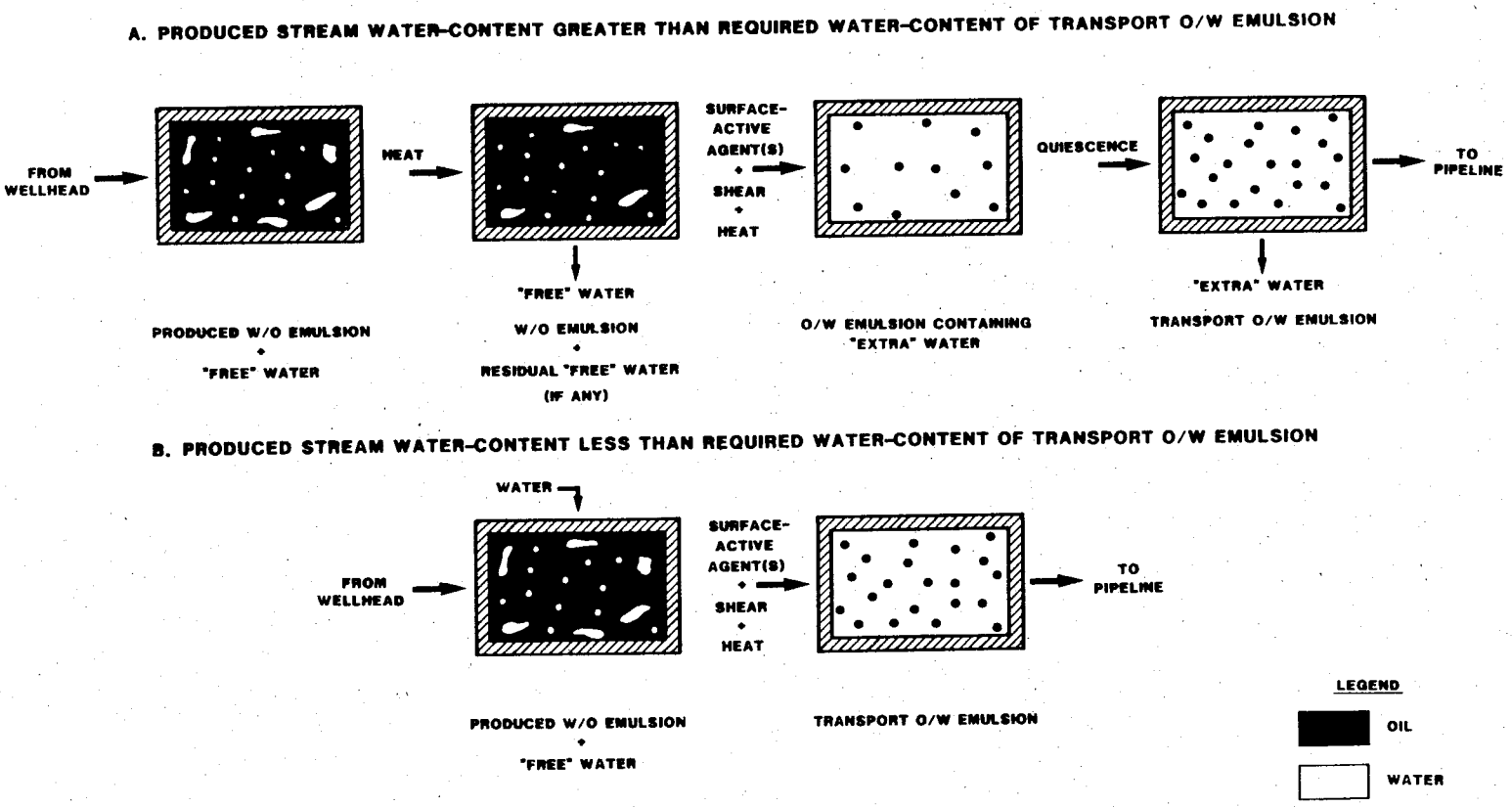
FIG. 2 illustrates in block diagram, the two sequences for forming O/W emulsions in accordance with the invention.

With reference to FIGS. 1 and 2, the invention can be generalized by considering a set of production wells in a heavy oil field where the oil is being produced from a reservoir having a strong water-drive. Consider that the water-cuts are high and that the wells have the appropriate artificial lift systems, e.g., electrical submersible pumps. The production streams from the individual wells are taken to a central point above the ground, where they are commingled. However, it should be noted that the method of formulating the O/W emulsion in accordance with the invention can be carried out at an individual wellhead. At this central location, the commingled production stream will usually consist of the following components: a W/O emulsion, "free" water, and some associated gas (if any). For illustrative purposes, we will assume that these wells have low-producing gas-oil ratios.

The water present in the produced stream can be classified into two categories: "bound" water and "free" water. "Bound" water is that water which is locked up as a W/O emulsion. Separating this water from the stream typically requires applying the appropriate combination of heat, mixing and chemical additive(s). "Free" water is that water which is relatively loosely held up by the oil and can be removed just by heating the stream to the right temperature. The amount of "free" water which can be removed will depend upon the temperature to which the stream is heated.

This mixture of produced W/O emulsion, "free" water and associated gas, if any, is fed into a heated vessel, where a certain portion of the "free" water may be dropped out, with separation of most, if not all, of the associated gas. Ihe effluent from this vessel is then mixed with an appropriate concentration of an emulsifier, and is fed into an emulsification unit. Alternatively, depending upon the equipment available at the site, the stream may be fed directly to the emulsification unit without any "free" water separation.

The emulsification unit is equipped with a heating unit and a mixer. In the emulsification unit, the idea is to use the emulsifier at the appropriate temperature, shear to coalesce substantially all the water ("bound" and "free") present in the incoming stream into one continuous phase, and simultaneously disperse the oil phase in the form of small droplets in this newly-formed continuous water phase. The objective is to essentially invert the stream of the W/O emulsion and "free" water into a water-external O/W emulsion. The degree of inversion sought is close to 100%. The produced W/O emulsion and "free" water mixture is essentially transformed into an O/W emulsion in one step. The concentration and the nature of the emulsifier are chosen for the ability to achieve the required degree of inversion and also bind up and stabilize only that amount of water in the newly-formed O/W emulsion as is necessary to obtain a low enough viscosity from a pipelining standpoint. Any extra water will be loosely bound and should separate out easily in a quiescent storage vessel.

The O/W emulsion containing excess water (over what is required from a pipelining standpoint) is then fed into a large storage vessel, where it has enough residence time in a quiescent environment, so that the excess water that was not bound up by the emulsifier drops to the bottom of the vessel and can be drained out. In addition to containing the proper amount of water, the O/W emulsion should contain just enough emulsifier to maintain its stability over long pipelining periods and withstand any pipeline shutdowns and start-ups. Finally, the emulsion is one that can be easily dewatered and desalted to the necessary marketing specifications at the downstream end of the pipeline, using known methods and technology.

With specific reference to FIG. 1, there is shown a schematic of a typical facility for applying the invention in the field. The solid lines show equipment essential to the practice of the invention, and dashed lines indicate optional equipment. Production from a series of producing wells is introduced via flowlines 10, 12 and 14 to a common manifold 16. The commingled production coming into the common manifold will be a mixture of a W/O emulsion, "free" water and some associated gas, if any. The production from any well can be fed by manipulation of gate valves 18 and 20, either to the test facility for gauging the oil production rate and the water-content of the stream, or directly through line 24 to the "free" water knock-out unit (FWKO) 26, which is an optional piece of equipment.

The FWKO is operated under pressure and has a heating unit 30 in it which allows the process stream to be heated to any pre-set temperature within the unit design constraints. This temperature is set at the level needed to formulate the O/W emulsion. In the FWKO unit, depending upon the temperature, a portion, if not all, of the "free" water will drop out of the stream and can be drained off from the bottom through line 32 to the water supply tank 34, which is also optional. The water from this tank can be used, if necessary, employing control system 36 to increase the water-content of the FWKO effluent. Most of the co-produced gas should separate out in the FWKO and is vented through valve 28 to the flare. The FWKO effluent is essentially a mixture of a W/O emulsion and residual "free" water, if any.

If the initial system for separating out the "free" water and/or heating the stream is not employed, all the equivalent steps may be employed in emulsification unit 51. Independent of whether or not an optional system for water separation and/or heating of the stream for proper formation of an O/W emulsion is employed, the feed metered by meter 38 with a cut monitor and a sampler, is combined with the proper amount of the emulsifier from storage unit 40. The emulsifying agent is pumped out of the tank through line 46 via a flow rate meter 44 and is combined with the as-produced or pre-processed stream. The mix is passed through an in-line mixer 50 to the emulsification unit 51. The emulsification unit has a heating unit 54 and an agitator 52, which is a back-up to the in-line mixer and is optional. The objective in this unit is to coalesce all the water present in the feed stream as a W/O emulsion and as "free" water into one continuous phase and simultaneously disperse all the oil in the form of small droplets in this continuous water phase. The idea is to invert the water-in-oil emulsion and "free" water into an oil-in-water emulsion in one step. The degree of inversion sought is 100%. The emulsion is formed at a temperature of from about 100° to about 200° F., preferably from about 130° to about 170° F. The amount of emulsifier used may range from about 100 to about 5,000 ppm weight-to-weight of the hydrocarbon crude, typically from about 500 to about 2,500 ppm by weight, desirably from about 700 to about 1,000 ppm by weight-to-weight.

The actual water-content of the W/O emulsion initially processed at this stage may vary widely. It may contain up to 95% by volume water, or it may be a relatively dry oil containing less than the amount of water required to form a low-viscosity O/W emulsion that is pipeline-pumpable. The object is to provide an O/W emulsion containing from about 15% to about 35% by weight water, preferably from about 20% to about 30% by weight water. To this end, tank 34 is used to provide water externally derived and stored or recovered from the as-received wellhead production stream by separation in unit 26 to adjust the water-content of the O/W emulsion for it to have an optimum viscosity for pipeline pumping. Consequently, the amount of emulsifier added from unit 40 is controlled so as to form a stable O/W emulsion of a water concentration suited for low-viscosity pipeline pumping. Any extra water will be loosely bound and should separate easily on keeping the stream quiescent. Excess emulsifier is, therefore, to be avoided in order to prevent the binding up and inclusion of too much water in the O/W emulsion and increase thereby, despite low viscosity, energy requirements for transportation, or to preclude the introduction of too little emulsifier such that, although there is formed an initial complete O/W emulsion, the amount of emulsifier present is too little to sustain the emulsion at an ambient-temperature viscosity level suitable for pipeline transportation.

The effluent of the emulsification unit should essentially be a water-external, O/W emulsion. However, this O/W emulsion may contain quite a bit of extra water relative to that required to achieve a certain pipeline viscosity. This effluent goes through a sampler 56 whereby the quality of the inversion achieved, can be checked. If needed, it can be recycled through line 58 and tank 53 back to the emulsification unit 51 to ensure formation of a proper O/W emulsion. The properly formed O/W emulsion goes through a degassing boot 64 into the shipping tank 72. In the shipping tank the objective is to have enough residence time in a quiescent enough environment such that all of the extra water will settle down to the bottom of the tank so that the effluent O/W emulsion will contain the right amount of water necessary from a pipeline-viscosity standpoint. The extra water settling to the bottom of tank 72 can be drained off to the sump. The quality of the oil-in-water emulsion is checked by another meter with a cut monitor and sampler 70 and, if satisfactory, it is sent to pipeline 80 for transportation to the desired destination.

If the effluent O/W emulsion from the tank 72 is not suitable for pipelining, it can be recycled through line 76 and tank 82, back into shipping tank 72 or, if necessary, through line 66 back to the emulsification unit. At this point, it should be noted that as long as the amount of water in the effluent O/W emulsion is greater than what is needed, there should be no problem from a pipeline-viscosity standpoint. However, the excess cannot be too large because there may be limitations in the pipeline from a pumping-capacity standpoint. There will definitely be a problem if the amount of water in the effluent O/W emulsion is less than what is required from an effective pipeline-viscosity standpoint.

As indicated, in the practice of the invention the objective is to take a produced stream of a mixture of water-in-oil emulsion and "free" water; optionally drop out a portion of the "free" water, if necessary, or add some water as the case may be; mix the remaining stream with the appropriate concentration of an emulsifying agent (mixture of surface-active chemicals); and then invert the same into an oil-in-water emulsion in one step. The idea is to coalesce all the water present in the feed stream as a W/O emulsion and as "free" water into one continuous phase, and simultaneously disperse all the oil in the form of small droplets in the newly-formed continuous water phase. The concentration of the emulsifier used is tailored such that during the process of inversion the amount of water which is bound up strongly in the oil-in-water emulsion will be very close to what is required from a viscosity standpoint. Any extra water, as opposed to "free" water, which is loosely held up in the oil-in-water emulsion is then removed by passing it through a quiescent storage unit and the eftluent stream is transported through the pipeline.

All supplying systems used to form the O/W emulsions are catered to the effluent of the wells. Generally, unless a broad-based emulsifying agent is used, a mixture of at least two emulsifying agents is employed. Surface-active agents used to form O/W emulsions may be anionic, cationic, nonionic, amphoteric, and the like. A desired and preferred characteristic is a high degree of oil insolubility. Preferably, the surface active agents are substantially insoluble in oil. Most of the inexpensive and efficient candidates for forming crude O/W emulsions are either anionic or nonionic. Nonionics are presently preferred because they are generally cheaper and not affected by the salinity of the water.

The best known of all the anionic-active emulsifying agents are the soaps which are the salts of the long-chain fatty acids, derived from naturally occurring fats and oils, in which the acids are found as triglycerides. The soaps used as emulsifying agents may be obtained from natural oils, in which case they will consist of a mixture of fatty acids, the precise nature of the mixture depending on the fat or oil employed. The mixed fatty acids of tallow, coconut oil, palm oil, and the like, are those commonly employed. The acids derived from tallow, for instance, may be partially separated by filtration or by pressing into "red oil" (principally oleic acid) and the the so-called "stearic acid" of commerce, which is sold as single-, double-, or triple-pressed, depending on the extent to which oleic acid is separated. Such stearic acid is actually a mixture of stearic and palmitic acids.

The nonionic surface-active agents can be classified into five types, namely, ether linkage, ester linkage, amide linkage, miscellaneous linkages, and multiple linkage. The preferred nonionic emulsifiers are selected from the compounds having the general formula:

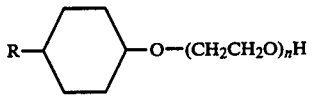

and

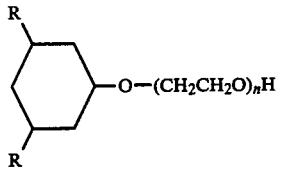

where R is any hydrocarbon group and n is the number of polyoxethylene groups ranging from about 4 to about 100, preferably about 30 to about 100, and substantially oil insoluble.

The most prominent members of this class are those compounds formed by the reaction of a hydrophobic hydroxyl-containing compound, e.g., an alcohol or phenol, with ethylene oxide, or, to a lesser extent, propylene oxide. The ethylene oxide groups, for example, may be added to any desired extent.

Nonionic surface-active agents having an ester linkage include compounds of the following general formula:

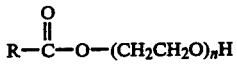

where R and n are as defined above.

The esters formed by the reaction of the fatty acid with polyhydric alcohols are a particularly interesting group of nonionic emulsifiers, in that, depending on the nature of the alcohol used, they may be predominantly hydrophilic and are especially suitable as O/W emulsifiers.

An example of an ester-linkage surfactant which is a good emulsifier is:

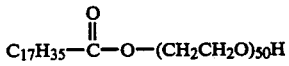

The presently preferred ester linkage surfactants are of the formula:

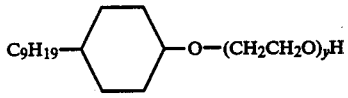

wherein y is from about 9 to about 100 with at least a portion of the agent being compounds wherein y is at least about 40 to ensure a substantial degree of oil insolubility.

Nonionic emulsifiers with amide linkages are compounds of the general formula:

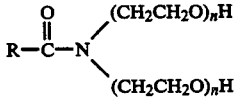

where R and n are as defined above.

The emulsifier system used in the practice of the invention must enable formation of the O/W emulsion at elevated temperatures and retention of stability at ambient temperatures. Unless broad-based for such functionality, a mixture of two or more emulsifiers is employed, and is particularly preferred.

There are several advantages for applying the invention for formulating oil-in-water emulsions in the field:

(a) It would be particularly useful in the initial stages of developing a new field or in a field where there are only about one or two wells and it is not economical to construct a large production facility. In such instances, the invention reduces the number and the size of the mechanical facilities to be installed. This is because inverting in one stage the mixture of the produced W/O emulsion and the "free" water, if any, eliminates the need to have one unit for demulsification and one unit for emulsification. As mentioned earlier, the process may be optimized by separating, if necessary, some of the "free" water out of the produced stream before making the emulsion; however, this is not essential. For example, in a new field where there is no production facility, the total stream of the produced W/O emulsion and all the "free" water can be inverted into an O/W emulsion in one stage. There would be employed an appropriate concentration of the right emulsifier mixture to bind up only that portion of the water required for obtaining the effective viscosity needed for pipelining. Broadly speaking, applying the invention would really involve having a mixing device, an emulsification unit, and a settling tank for dropping off the excess water. If this new field is close to an existing field with a large production facility, the O/W emulsion containing excess water can be injected directly into a short pipeline to this neighboring facility. In this event, the settling tank can be eliminated.

In summary, formulating an O/W emulsion by this method can potentially decrease the capital cost of a production facility to be installed in a new heavy-oil field. Furthermore, since the produced stream is not demulsified first, it can also potentially reduce the chemical cost.

(b) If the wells have high water-cuts, there will be a lot of co-produced water. Using the co-produced water to form the emulsion will alleviate the water-disposal problem.

(c) It has been observed during pipelining of an O/W emulsion formulated by mixing water and an emulsifying agent with a dried oil stream, that some of the water is transferred from the external, continuous phase into the oil droplets. This can, depending upon the extent of the water lost to the oil, increase the effective viscosity of the O/W emulsion, which can lead to problems if it is necessary to stop and restart the pipeline. The amount of water lost to the oil during the transport of the O/W emulsion is less if the oil is not treated and dried before it is emulsified. Hence, formulating an O/W emulsion by inverting the produced W/O emulsion in one step, as outlined in the invention, would be better for long-distance pipeline applications.

Without limiting, the following Examples illustrate, the instant invention in part.

EXAMPLE 1

The oil samples used for these investigations were from the Jibaro Field in the Peru Oriente, and were provided in 5-gallon containers. Karl Fisher water analyses were performed, revealing that the four samples each contained 51%, plus or minus 2%, total water. The samples were heated to 65° C. (149° F.) for 4 hours, and any "free" water that separated out, was removed. Only 2% of the water in the samples dropped out on heating to this temperature. The warm W/O emulsion was then mixed with the appropriate amount of emulsifier in a mixer. Mixing energies and times were kept to a minimum. The O/W emulsions formed were then allowed to stand for 30 minutes and viscosities were measured. Emulsifier was added, either directly to the W/O emulsion or dissolved in 5 weight-percent produced water which had been separately made available. The emulsifying agent was a mixture of two surface-active chemicals, manufactured and sold by Tetrolite, of St. Louis, MO, a division of Petrolite Corporation. The reversal of emulsion phases was found to be more delicate than emulsifying relatively dry oil into water. Adding demulsifier to the W/O emulsion such that some water was dropped out before adding the emulsifier, did not appear to be as effective as operating on the provided W/O emulsion, in that the system was very limited in allowable temperatures, mixing times and treating rates.

The results of forming O/W emulsions by directly inverting the produced W/O emulsions at an emulsifier concentration of 2,000 ppm, based on the weight of the treated W/O emulsion, are shown in Tables I and II.

TABLE I

| 70° F. Viscosity vs. Shear Rate | |
|---|---|
| As-Formed Shear Rate sec.$^{-1}$ | Viscosity, cp |
| 200 | 22 |
| 400 | 20 |
| 600 | 18 |
| 800 | 16 |
| 1000 | 14 |

TABLE II

| 70° F. Viscosity vs. Shear Rate | |
|---|---|
| Upper Phase after Water Separation Shear Rate sec.$^{-1}$ | Viscosity, cp |
| 200 | 177 |
| 400 | 160 |
| 600 | 151 |
| 800 | 132 |
| 1000 | 130 |

Stability of the O/W emulsions was measured by allowing the emulsions to stand quiescent overnight. About 24% by volume extra water dropped out. This indicates that the upper emulsified phase contained about 33% water by volume. Based on this information, it is believed feasible to invert, in one step, a W/O emulsion containing 50% or more water using from 1000 to 2000 ppm of the emulsifier, based on the weight of the treated W/O emulsion. The stability of these emulsions is such that, from 25% to 35% water is indefinitely stable. Based on viscosity data, it is estimated that the upper-phase emulsion, which contains a nominal 33% water, actually contains from about 28% to 30% water as a continuous phase and from 3% to 5% water as dispersed droplets.

EXAMPLE 2

Additional studies were performed using another batch of produced Jibaro W/O emulsion containing 50% water. The sample had been in storage for several months after being collected in the field and was old. No water had dropped out of the sample even though it had been stored for several months. This indicates that the sample was unduly refractory and less representative of fresh oilfield W/O emulsions.

The emulsifiers used in the testing series were the ethoxylated nonylphenols. They are all members of the general family of nonionic surface active agents of the formula:

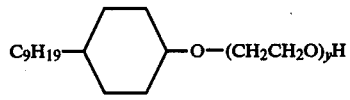

The ethoxylated nonylphenols (NP series) are characterized by y=4–100.

The following members of the NP family were tested:

| NP No. | y |
|---|---|
| NP-9 | 9 |
| NP-40 | 40 |
| NP-100 | 100 |

The required emulsifier concentration was found to depend strongly on the age of the produced W/O emulsion, the emulsification temperature and the mixing efficiency. In using an old W/O emulsion sample, only qualitative trends can be drawn about the behavior of the systems tested.

All the tests were conducted by shearing the mixture of the W/O emulsion and the added emulsifier using a rotorstator mixing device. In some cases, a small dose of a demulsifying agent, also produced by Tretolite, was added along with the emulsifier. The rotor-stator gap and the speed were adjusted to generate about $10^{-4}$ sec$^{-1}$ of shear. Each mixture was sheared at this same rate for about 40 seconds. No attempt was made to vary the manner in which the shear was applied. After shearing, the resulting mixture was stored under quiescent conditions for about 24 hours. It was then evaluated to determine whether it was oil-continuous (W/O) or water-continuous (O/W) by seeing if a sample of the emulsion dispersed easily in xylene or in water. Thereafter, it was placed under active storage for another 24 hours. The objective of the active storage test was to characterize the ability of the emulsifier to maintain the emulsion's integrity. This test is made to qualitatively simulate the dynamic phenomenon of droplet collison when the O/W emulsion is flowing through a pipeline. About 200 grams of the formulated mixture was placed in a shaker bath at 80° F. The shaker bath has a linear travel of 1-inch and was operated at 150 cycles/minute. After about 24 hours, the amount of water retained in the emulsion is determined by a simple measurement of the clear water volume. The higher the water content of the emulsion after the test, the more stable the emulsion.

Once again, the resulting emulsion was tested as before, to determine whether it was oil-continuous or water-continuous. The results of these preliminary tests are shown in Table III.

The following observations may be made from the data in Table III.

Water continuous O/W emulsions could not be made with this particular W/O emulsion sample under the particular experimental test conditions using 1000 ppm of the emulsifier. No attempt, however, was made to determine the minimum emulsifier dosage required to formulate stable O/W emulsions under the particular test conditions.

Both NP-40 and a 1-to-1 mixture of NP-40 and NP-100 when used in concentrations greater than or equal to 3000 ppm, under the particular experimental conditions, produced O/W emulsions with sufficient integrity to withstand the active storage test for 24 hours.

The presence of the Tretolite demulsifier did not appear to affect the process.

TABLE III

More Data on the Single Step Inversion of Jibaro W/O Emulsions Containing 50% Water

| Emulsification Temp. (°F.) | Emulsifier Conc. (ppm)* | Demulsifier[A] Conc. (ppm)* | Nature of Formulated Emulsion: After Quiescent Storage for 24 Hrs. | After Active Storage[B] for Another 24 Hrs. | Water Content (%) |
|---|---|---|---|---|---|
| Emulsifier: NP-40 | | | | | |
| 140 | 1000 | 0 | W/O | W/O | 35 |
| 189 | 1000 | 0 | W/O | W/O | 19 |
| 140 | 1000 | 200 | W/O | W/O | 35 |
| 189 | 1000 | 200 | W/O | W/O | 19 |
| 165 | 3000 | 100 | O/W | O/W | 32 |
| 165 | 3000 | 100 | O/W | O/W | 35 |
| 140 | 5000 | 0 | O/W | O/W | 39 |
| 189 | 5000 | 0 | O/W | O/W | 39 |
| 140 | 5000 | 200 | O/W | O/W | 37 |
| 189 | 5000 | 200 | O/W | O/W | 32 |
| Emulsifier: NP-40/NP-100 | | | | | |
| 140 | 1000 | 0 | W/O | W/O | 19 |
| 189 | 1000 | 0 | W/O | W/O | 15 |
| 140 | 1000 | 200 | W/O | W/O | 22 |
| 189 | 1000 | 200 | W/O | W/O | 13 |
| 165 | 3000 | 100 | O/W | O/W | 39 |
| 165 | 3000 | 100 | O/W | O/W | 37 |
| 140 | 5000 | 0 | O/W | O/W | 42 |
| 189 | 5000 | 0 | O/W | O/W | 39 |
| 140 | 5000 | 200 | O/W | O/W | 37 |
| 189 | 5000 | 200 | O/W | O/W | 32 |
| Emulsifier: NP-100 | | | | | |
| 140 | 1000 | 0 | W/O | W/O | 37 |
| 189 | 1000 | 0 | W/O | W/O | 13 |
| 140 | 1000 | 200 | W/O | W/O | 29 |
| 189 | 1000 | 200 | W/O | W/O | 15 |
| 165 | 3000 | 100 | W/O | W/O | 19 |
| 165 | 3000 | 100 | W/O | W/O | 15 |
| 140 | 5000 | 0 | O/W | W/O | 38 |
| 189 | 5000 | 0 | O/W | W/O | 21 |
| 140 | 5000 | 200 | O/W | W/O | 32 |
| 189 | 5000 | 200 | O/W | W/O | 19 |
| Emulsifier: NP-9/NP-40 | | | | | |
| 140 | 1000 | 0 | W/O | W/O | 26 |
| 189 | 1000 | 0 | W/O | W/O | 6 |
| 140 | 1000 | 200 | W/O | W/O | 7 |
| 189 | 1000 | 200 | W/O | W/O | 6 |
| 165 | 3000 | 100 | O/W | W/O | 6 |
| 165 | 3000 | 100 | O/W | W/O | 3 |
| 140 | 5000 | 0 | O/W | W/O | 13 |
| 189 | 5000 | 0 | O/W | W/O | 8 |
| 140 | 5000 | 200 | O/W | W/O | 7 |
| 189 | 5000 | 200 | O/W | W/O | 13 |

*Based on the weight of the W/O emulsion
[A]Tretolite Product.
[B]Put in Active Storage after being stored under quiescent conditions for 24 Hrs.

Other studies have established that the phase inversion temperature, or the temperature above which a water continuous emulsion cannot be formed, is a measure of effectiveness or oil insolubility of the emulsifier. In general, it is desired that the system have a phase inversion temperature of at least about 185° F.

It has also been observed that the temperature of preparation of the emulsion will affect phase inversion temperature, the latter increasing with an increase in the temperature of emulsion preparation.

What is claimed is:

1. A process for the production of an oil-in-water emulsion for pipeline transmission which comprises:

(a) producing a hydrocarbon crude including a water-in-oil emulsion;

(b) adding to said hydrocarbon crude when said crude is at a temperature of from about 100° to about 200° F., an emulsifier system capable of forming and sustaining an oil-in-water emulsion at said temperature and at ambient pipeline transmission temperatures, the amount of emulsifier system added being sufficient to form and sustain an oil-in-water emulsion having a selected water content of from about 15 percent to about 35 percent by weight water and a viscosity sufficiently low for pipeline transmission;

(c) agitating the hydrocarbon crude including a water-in-oil emulsion and the added emulsifier system, to form an oil-in-water emulsion; and (d) separating any excess water from the formed oil-in-water emulsion.

2. A process as claimed in claim 1 in which the temperature of the hydrocarbon crude including a water-in-oil emulsion, is from about 130° to about 170° F. during formation of the oil-in-water emulsion.

3. A process as claimed in claim 1 in which the emulsifier system contains at least one emulsifier capable of sustaining the oil-in-water emulsion at the elevated temperature and at least one emulsifier capable of sustaining the formed oil-in-water emulsion at ambient temperatures of pipeline transmission.

4. A process as claimed in claim 1 in which the emulsifier system is provided in a concentration of from about 100 to about 5000 ppm by weight of the hydrocarbon crude.

5. A process as claimed in claim 1 in which the emulsifier system is provided in a concentration of from about 500 to about 2500 ppm by weight of the hydrocarbon crude.

6. A process as claimed in claim 1 in which the hydrocarbon crude including a water-in-oil emulsion, contains less than 15 percent by weight water, and water is added for formation of the oil-in-water emulsion.

7. A process as claimed in claim 1 in which the hydrocarbon crude contains "bound" and "free" water, and at least a portion of the "free" water is separated from the hydrocarbon crude prior to forming the oil-in-water emulsion.

8. A process for the production of an oil-in-water emulsion for pipeline transmission which comprises:

(a) producing a hydrocarbon crude including a water-in-oil emulsion and containing in excess of 35 percent by weight water;

(b) elevating the temperature of the hydrocarbon crude including a water-in-oil emulsion to a temperature of about 100° to about 200° F., and adding an emulsifier system capable of forming and then sustaining an oil-in-water emulsion at said temperature and at ambient pipeline transmission temperatures, the amount of emulsifier system added being sufficient to form and sustain an oil-in-water emulsion having a selected water content of from about 15 percent to about 35 percent by weight and a viscosity sufficiently low for pipeline transportation;

(c) agitating the hydrocarbon crude including a water-in-oil emulsion and the added emulsifier system, to form an oil-in-water emulsion; and (d) separating excess water from the formed oil-in-water emulsion.

9. A process as claimed in claim 8 in which the temperature of the hydrocarbon crude including a water-in-oil is from about 130° to about 170° F. during formation of the oil-in-water emulsion.

10. A process as claimed in claim 8 in which the emulsifier system contains at least one emulsifier capable of sustaining the oil-in-water emulsion at the temperature of formation and at ambient temperatures of pipeline transmission.

11. A process as claimed in claim 8 in which the emulsifier system is provided in a concentration of from about 100 to about 5000 ppm by weight of the hydrocarbon crude.

12. A process as claimed in claim 8 in which the emulsifier system is provided in a concentration of from about 500 to about 5000 ppm by weight of the hydrocarbon crude.

13. A process as claimed in claim 8 in which the hydrocarbon crude including a water-in-oil emulsion contains up to 95 percent by weight water.

14. A process as claimed in claim 10 in which the hydrocarbon crude including a water-in-oil emulsion contains up to 95 percent by weight water.

15. A process for the production of an oil-in-water emulsion for pipeline transmission which comprises:

(a) producing a hydrocarbon crude including a water-in-oil emulsion and containing more than 35 percent by weight water in the form of "bound" and "free" water;

(b) separating at least a portion of the "free" water from the hydrocarbon crude;

(c) elevating the temperature of the hydrocarbon crude including a water-in-oil emulsion to a temperature of from about 100° to about 200° F., and adding an emulsifier system capable of forming then sustaining an oil-in-water emulsion at said temperature and at ambient pipeline transmission temperatures, the amount of emulsifier system added being sufficient to form and sustain an oil-in-water emulsion having a selected water content of from about 15 percent to about 35 percent by weight water and a viscosity sufficiently low for pipeline transportation;

(d) agitating the hydrocarbon crude including a water-in-oil emulsion and the added emulsifier system, to form an oil-in-water emulsion; and (e) separating any excess water from the formed water-in-oil emulsion.

16. A process as claimed in claim 15 in which the temperature of the crude is from about 130° to about 170° F. during formation of the oil-in-water emulsion.

17. A process as claimed in claim 15 in which the emulsifier system contains at least one emulsifier capable of sustaining the oil-in-water emulsion at the temperature of formation and at least one emulsifier capable of sustaining the formed oil-in-water emulsion at ambient temperatures of pipeline transmission.

* * * * *